US011046467B2

(12) United States Patent
Hayashi

(10) Patent No.: US 11,046,467 B2
(45) Date of Patent: Jun. 29, 2021

(54) PACKAGING APPARATUS

(71) Applicant: Ishida Co., Ltd., Kyoto (JP)

(72) Inventor: Mitsunobu Hayashi, Ritto (JP)

(73) Assignee: Ishida Co., Ltd., Kyoto (JP)

( * ) Notice: Subject to any disclaimer, the term of this patent is extended or adjusted under 35 U.S.C. 154(b) by 511 days.

(21) Appl. No.: 15/265,530

(22) Filed: Sep. 14, 2016

(65) Prior Publication Data

US 2017/0081066 A1 Mar. 23, 2017

(30) Foreign Application Priority Data

Sep. 18, 2015 (JP) ..... JP2015-185633

(51) Int. Cl.
*B65B 57/04* (2006.01)
*B65B 59/00* (2006.01)
(Continued)

(52) U.S. Cl.
CPC ..... *B65B 41/16* (2013.01); *B65B 11/54* (2013.01); *B65B 41/14* (2013.01); *B65C 1/021* (2013.01);
(Continued)

(58) Field of Classification Search
CPC ..... B65B 41/12; B65B 41/14; B65B 41/16; B65C 1/021; B65H 20/06; B65H 35/06;
(Continued)

(56) References Cited

U.S. PATENT DOCUMENTS 3,505,781 A * 4/1970 Loewenthal ..... B65B 7/164 53/329.3
3,693,318 A * 9/1972 Balzer ..... B65B 7/164 53/329.3
(Continued)

FOREIGN PATENT DOCUMENTS

JP 2001-106202 A 4/2001
JP 2001106202 A * 4/2001
(Continued)

OTHER PUBLICATIONS

An Office Action mailed by the Japanese Patent Office dated Aug. 27, 2019, which corresponds to Japanese Patent Application No. 2015-185633 and is related to U.S. Appl. No. 15/265,530; with English translation.

*Primary Examiner* — Thanh K Truong
*Assistant Examiner* — David G Shutty
(74) *Attorney, Agent, or Firm* — Studebaker & Brackett PC

(57) ABSTRACT

A packaging apparatus includes a controller configured to control operation of a first conveying unit, a second conveying unit, a first moving unit, and a second moving unit. When a film is loaded onto the first conveying unit and the second conveying unit, the controller causes a first clamp unit to clamp the film delivered from a delivering unit and causes a first feeder portion to convey the film. Simultaneously, while causing a second clamp unit to be released or the second clamp unit to intermittently clamp the film delivered from the delivering unit, the controller causes a
(Continued)

second feeder portion to convey the film and also causes the second conveying unit to move in a direction separating from the first conveying unit and, when the second conveying unit reaches a predetermined position, causes the second clamp unit to clamp the film.

2 Claims, 12 Drawing Sheets

(51) Int. Cl.

| | |
|---|---|
| ***B65B 41/16*** | (2006.01) |
| ***B65B 41/14*** | (2006.01) |
| ***B65B 11/54*** | (2006.01) |
| ***B65C 1/02*** | (2006.01) |
| ***B65H 20/06*** | (2006.01) |
| ***B65H 35/06*** | (2006.01) |

(52) U.S. Cl.
CPC ..... *B65H 20/06* (2013.01); *B65H 35/06* (2013.01); *B65H 2301/41392* (2013.01); *B65H 2301/44352* (2013.01); *B65H 2404/256* (2013.01)

(58) Field of Classification Search
CPC ..... B65H 2301/41392; B65H 2301/44352; B65H 2404/256
USPC .. 53/389.1, 389.2, 389.3, 389.4, 389.5, 441, 53/446
See application file for complete search history.

(56) References Cited

U.S. PATENT DOCUMENTS 3,967,433 A * 7/1976 Bonfiglioli ..... B65B 11/54 53/441
4,947,623 A * 8/1990 Saito ..... B65B 57/10 53/450
4,951,447 A * 8/1990 Denda ..... B65B 11/54 53/131.2
5,157,903 A * 10/1992 Nakashima ..... B65B 11/54 493/476
5,485,712 A * 1/1996 Cherney ..... B65B 9/2028 53/436
5,603,198 A * 2/1997 Rimondi ..... B65B 11/54 53/228
5,653,093 A * 8/1997 Delledonne ..... B65B 11/54 53/141
5,749,202 A * 5/1998 Eichbauer ..... B32B 27/08 53/399
5,826,401 A * 10/1998 Bois ..... B65B 9/20 53/412
6,409,958 B1 * 6/2002 Hosono ..... B29C 47/0021 264/210.7
2005/0193684 A1 * 9/2005 Mise ..... B65B 11/54 53/64
2011/0239839 A1 * 10/2011 Yoshida ..... B26D 1/085 83/79
2012/0117923 A1 * 5/2012 Hastreiter ..... B65B 59/001 53/461
2012/0193022 A1 * 8/2012 Yamasita ..... B65C 1/021 156/249
2012/0204516 A1 * 8/2012 Palumbo ..... B65B 11/52 53/403
2017/0081066 A1 * 3/2017 Hayashi ..... B65B 41/16
2017/0081068 A1 * 3/2017 Hayashi ..... B65C 1/021
2017/0099853 A1 * 4/2017 Maldarelli ..... A23G 4/02
2018/0118395 A1 * 5/2018 Guzman ..... B65B 11/08

FOREIGN PATENT DOCUMENTS

JP 2001-287706 A 10/2001
JP 4764577 B2 * 9/2011
JP 2012-176772 A 9/2012
JP 2012-176777 A 9/2012
JP 2012176778 A * 9/2012
JP 2012176778 A * 9/2012

* cited by examiner

1

PACKAGING APPARATUS

TECHNICAL FIELD

The present disclosure relates to a packaging apparatus.

BACKGROUND

As a conventional packaging apparatus, an apparatus described in Japanese Unexamined Patent Publication No. 2001-106202, for example, is known. This packaging apparatus described in Japanese Unexamined Patent Publication No. 2001-106202 includes: a delivering unit configured to deliver a film from a film roll when the film roll is newly set; first and second feeder portions configured to hold the film delivered from the delivering unit with first and second clamp units, respectively, to deliver the film in a longitudinal direction; a moving unit configured to change relative distance between the first and the second feeder portions in a film-width direction; and a controller configured to cause the first and the second feeder portions to deliver the film in a film longitudinal direction while causing the moving unit to increase the relative distance between the first and the second feeder portions in the film-width direction.

SUMMARY

In the conventional packaging apparatus, the film delivered by the delivering unit is held by the first clamp unit and the second clamp unit, and the first feeder portion and the second feeder portion convey the film. At this time, for example, when the film is adhesive, the film may adhere to the feeder portions, which may result in delay in feeding of the film and formation of a bundle (heap) of films inside the feeder portions. In this case, a problem may occur in that, for example, the film jams in the feeder portions and load is accordingly applied to a component such as a drive unit configured to drive the feeder portions.

One aspect of the present disclosure aims to provide a packaging apparatus that can prevent occurrence of such a problem due to film jam.

A packaging apparatus according to one aspect of the present disclosure is a packaging apparatus configured to package an object to be packaged by covering the object to be packaged with a film that is stretched while a peripheral portion of the film is being held. The packaging apparatus includes: a delivering unit configured to deliver the film from a film roll onto which the film is wound; a first conveying unit including a first clamp unit and a first feeder portion, the first clamp unit being configured to clamp the film delivered from the delivering unit, the first feeder portion being configured to convey the film clamped by the first clamp unit in a first direction that is a direction in which the film is paid out; a second conveying unit including a second clamp unit and a second feeder portion, the second clamp unit being configured to clamp the film delivered from the delivering unit, the second feeder portion being configured to convey the film clamped by the second clamp unit in the first direction; a first moving unit configured to move the first conveying unit in a second direction that is a width direction of the film, a second moving unit configured to move the second conveying unit in the second direction; and a controller configured to control operation of the first conveying unit, the second conveying unit, the first moving unit, and the second moving unit. When the film is loaded onto the first conveying unit and the second conveying unit, the controller causes the first clamp unit to clamp the film delivered by the delivering unit and causes the first feeder portion to convey the film. Simultaneously, while causing the second clamp unit to open or the second clamp unit to intermittently clamp the film delivered by the delivering unit, the controller causes the second feeder portion to convey the film and also causes the second conveying unit to move in a direction separating from the first conveying unit and, when the second conveying unit reaches a predetermined position in the second direction, causes the second clamp unit to clamp the film.

In the packaging apparatus according to the one aspect of the present disclosure, while causing the second clamp unit to open or the second clamp unit to intermittently clamp the film delivered by the delivering unit, the controller causes the second feeder portion to convey the film and, when the second conveying unit reaches the predetermined position (predetermined position in the film-width direction) in the second direction, causes the second clamp unit to clamp the film. Accordingly, until the second conveying unit reaches the predetermined position in the second direction, the film is not clamped by the second clamp unit or is intermittently clamped by the second clamp unit. This can prevent the film from adhering to the second feeder portion at least until the predetermined position is reached, which makes it possible to prevent formation of a bundle of films inside the second feeder portion. Thus, the packaging apparatus can prevent occurrence of a problem due to film jam.

In one embodiment, the packaging apparatus may further include a cutting unit configured to cut the film between the delivering unit and the first and the second conveying units, in which the controller may cause the cutting unit to cut the film and then cause the first clamp unit and the second clamp unit to release the clamped film. This enables an operator to easily remove the cut film.

In one embodiment, the predetermined position may be a position at a length equal to or greater than one half of film width in the width direction of the film. This enables the film to be further prevented from adhering to the feeders.

According to one aspect of the present disclosure, occurrence of a problem due to film jam can be prevented.

DETAILED DESCRIPTION

One embodiment will now be described with reference to the drawings. In the description of the drawings, like elements are designated by like numerals, and duplicate description is omitted.

Figure 1:
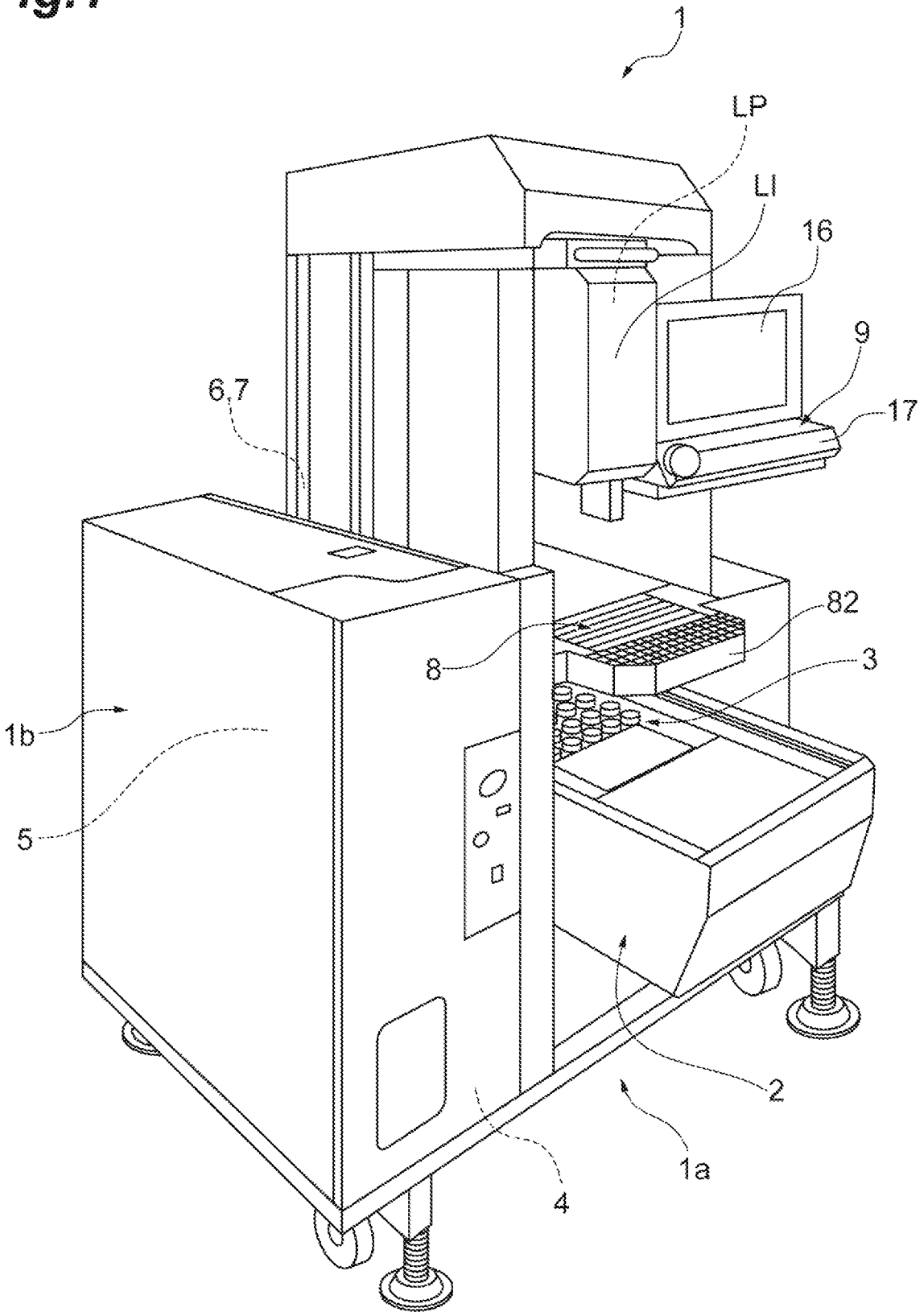
FIG. 1 is an external perspective view illustrating a packaging apparatus according to one embodiment.
Figure 2:
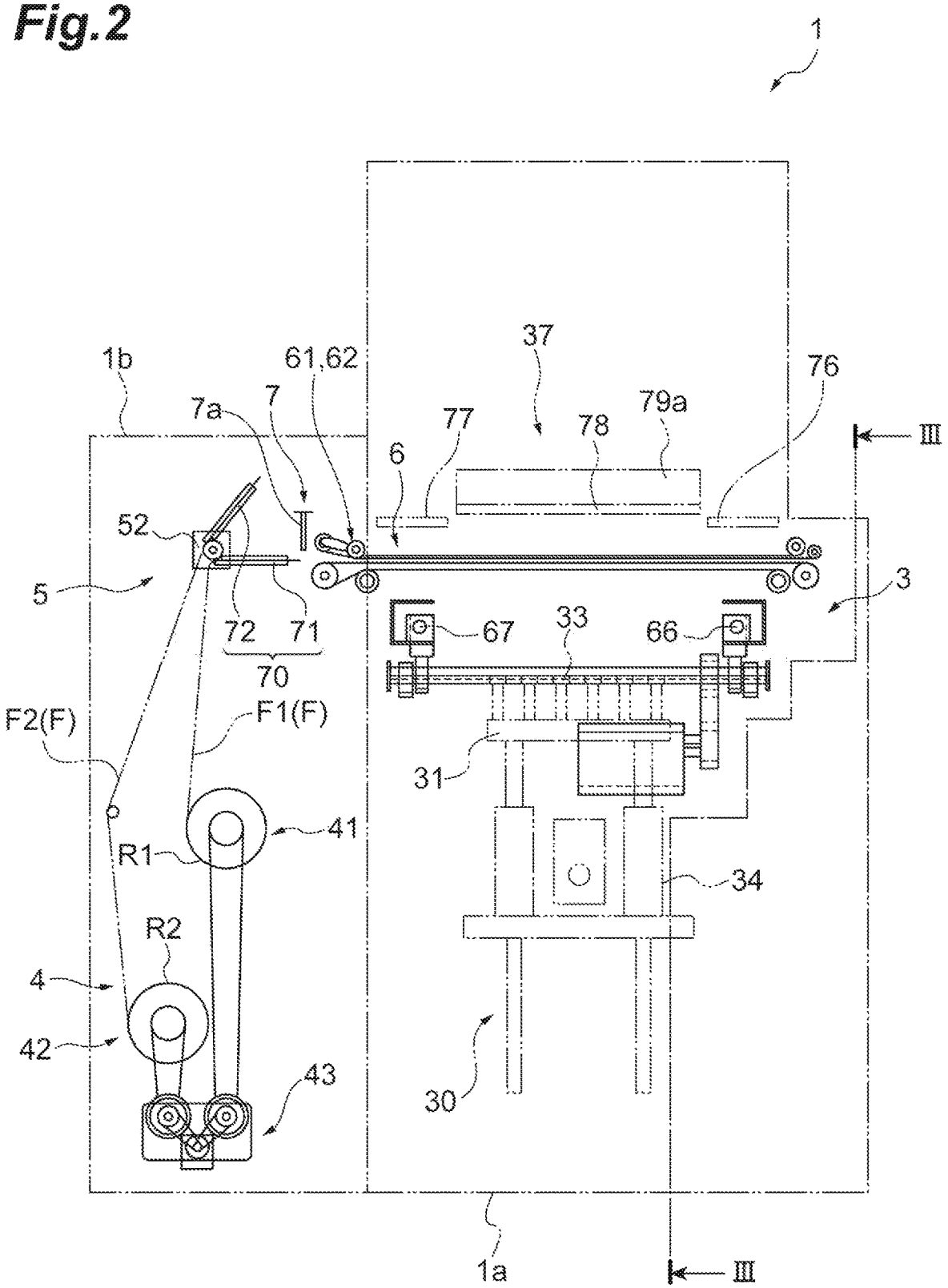
FIG. 2 is a schematic front view illustrating the inside of the packaging apparatus in FIG. 1.
Figure 3:
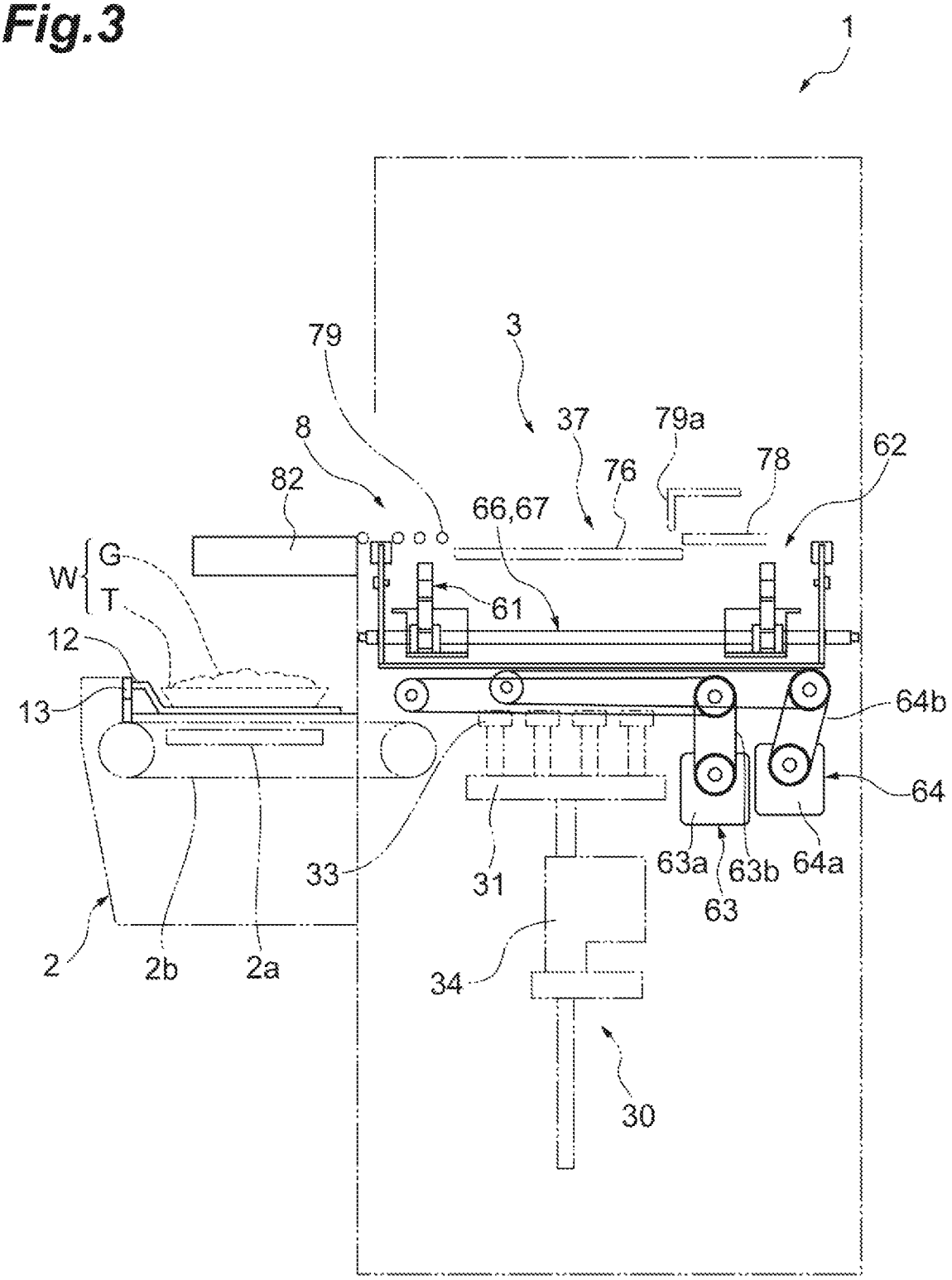
FIG. 3 is a schematic cross-sectional view taken along the line III-III, viewed in the direction of the arrows in FIG. 2.

As depicted in FIG. 1 to FIG. 3, a packaging apparatus 1 is an apparatus configured to film-package an object (object to be packaged) W including a product G such as a food product and a tray T on which the product G is placed. The packaging apparatus 1 packages an object W with a film F by pushing up the object W against a film F that is tensionally held and folding peripheral portions of the film F over the bottom side of the tray T. The packaging apparatus 1 includes a measuring function and a price-tagging function of affixing labels in addition to the film-packaging function.

The packaging apparatus 1 includes a measuring carrying-in mechanism 2, a packaging station 3, a roll holding mechanism 4, a film delivering mechanism (delivering unit) 5, a film conveyance mechanism 6, a cutter mechanism (cutting unit) 7, a seal mechanism 8, a label printer LP, a label issuing device LI, and a control unit 9. The respective mechanisms included in the packaging apparatus 1 are accommodated in a body 1*a* and a casing 1*b* of the packaging apparatus 1. The casing 1*b* is attached to a side portion of the body 1*a*.

In the description of the present embodiment, "right and left" mean right and left when facing the front of the body 1*a* of the packaging apparatus 1. The front side of the packaging apparatus 1 in the front-back direction is called "near side", and the side opposite thereto is called "far side". The expression "film F1, F2" means either one optionally selected from a film F1 and a film F2, and is also simply called a film F. The expression "film roll R1, R2" means either one optionally selected from a film roll R1 and a film roll R2. The terms "upstream" and "downstream" mean upstream of the film F in the conveying direction and downstream thereof in the conveying direction, respectively.

As depicted in FIG. 3, the measuring carrying-in mechanism 2 includes a measuring scale 2*a*, a carrying-in belt 2*b*, and a measuring vessel 12. The measuring scale 2*a* measures the weight of an object W placed on the measuring vessel 12, and outputs information on the weight of the object W to the control unit 9. The carrying-in belt 2*b* is looped over a pair of rollers. The carrying-in belt 2*b* is provided with a conveying bar 13 for conveying the object W. The conveying bar 13 moves toward the far side while being driven by the carrying-in belt 2*b*, and pushes the object W toward the far side. The conveying bar 13 extends along the width direction of the measuring vessel 12, and is positioned on the near side of the measuring vessel 12 in an initial position. The measuring vessel 12 is a tray having a shape of a rectangular shallow vessel on which the object W is placed.

The packaging station 3 is a space formed in the body 1*a*. The packaging station 3 is a space in which a series of film-packaging processes are performed on an object W the weight of which is measured by the measuring carrying-in mechanism 2. In the packaging station 3, a lifter mechanism 30 and a folding mechanism 37 are disposed.

The lifter mechanism 30 is provided in a lower portion of the packaging station 3. The lifter mechanism 30 receives the bottom surface of a tray T with a plurality of support members 33, and causes a electric ball screw mechanism 34 to move upward a support base 31 fixed to the support members 33. Consequently, the lifter mechanism 30 holds the bottom surface of the tray T and moves the object W upward. The lifter mechanism 30 pushes up the object W against a film (stretch film) F1, F2 that is tensionally held by the film conveyance mechanism 6.

The folding mechanism 37 folds the periphery of the film F1, F2 over the bottom side of the object W (i.e., the bottom side of the tray T) pushed up by the lifter mechanism 30 to cover the object W with the film F1, F2. The folding mechanism 37 folds both ends of the film F1, F2 in the film conveying direction over the bottom side of the tray T with right and left folding plates 76 and 77. The folding mechanism 37 folds a side portion of the film F1, F2 on the far side in the width direction over the bottom side of the tray T with a rear folding plate 78. When the tray T is discharged toward the seal mechanism 8 by a discharging pusher 79*a*, the folding mechanism 37 folds a side portion of the film F1, F2 on the near side in the width direction over the bottom side of the tray T with a front folding bar 79.

The roll holding mechanism 4 is disposed in the casing 1*b* as depicted in FIG. 1 and FIG. 2. The roll holding mechanism 4 is configured to hold two film rolls R1 and R2 that are of the same type or of different types. On the film rolls R1 and R2, films F1 and F2 having a predetermined width are wound multiple times, respectively.

As depicted in FIG. 2, the roll holding mechanism 4 includes an upper-roll holding unit 41 configured to hold the film roll R1, a lower-roll holding unit 42 configured to hold the film roll R2, and a roll drive unit 43 configured to cause the upper-roll holding unit 41 and the lower-roll holding unit 42 to selectively rotate to pay out the film F1 or the film F2 from either one of the film rolls R1 and R2.

The film delivering mechanism 5 is a mechanism configured to transfer the film F1 pulled out from the film roll R1 or the film F2 pulled out from the film roll R2 to a pair of feeder units 61 and 62 of the film conveyance mechanism 6. The film delivering mechanism 5 is disposed in the casing 1*b*.

Figure 6C:
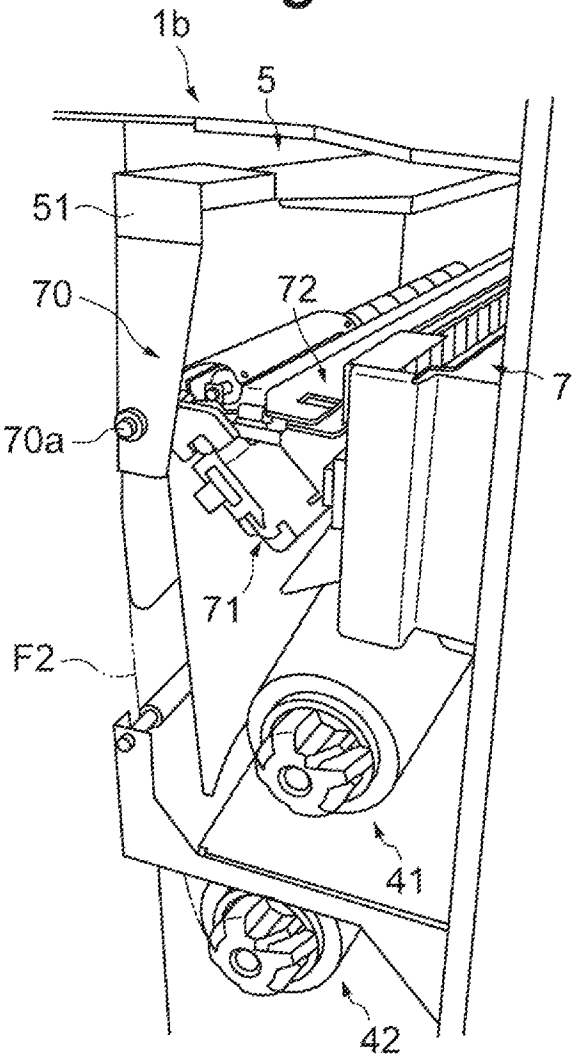
FIG. 6C is a perspective view illustrating the film delivering mechanism.
Figure 6B:
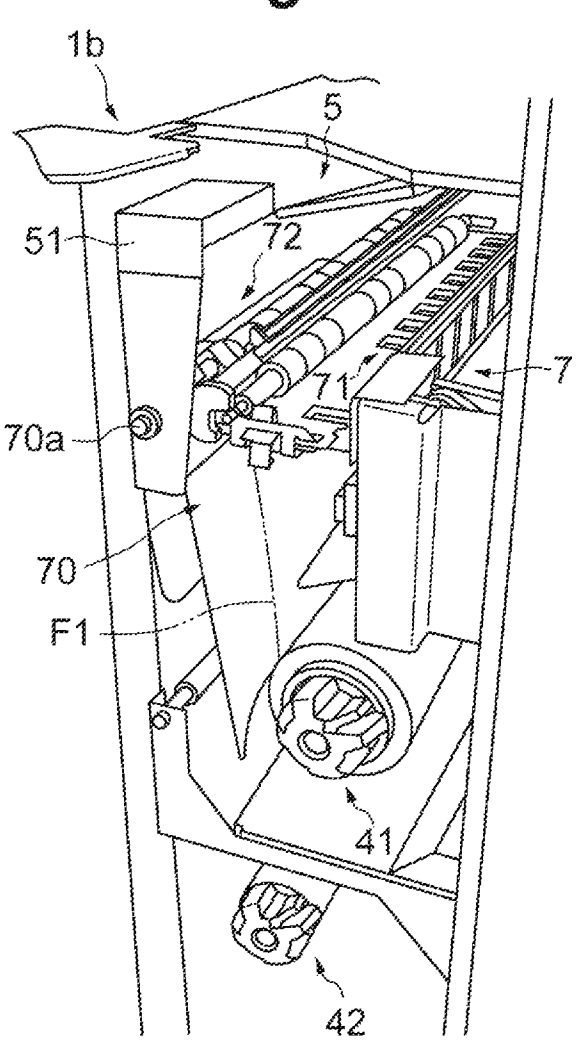
FIG. 6B is a perspective view illustrating the film delivering mechanism.
Figure 6A:
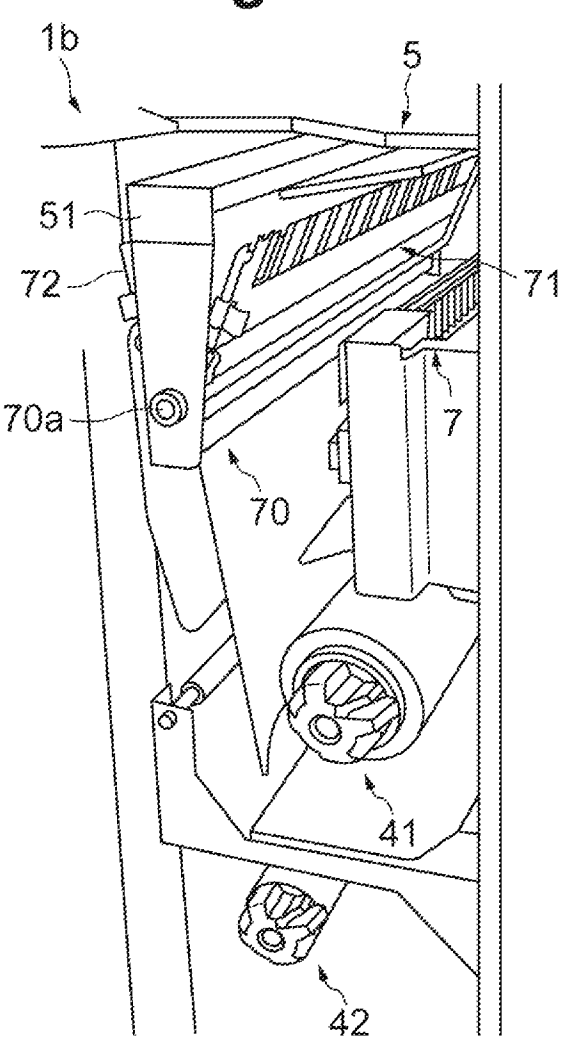
FIG. 6A is a perspective view illustrating a film delivering mechanism.

As depicted in FIG. 6A to FIG. 6C, the film delivering mechanism 5 includes a loading-unit movement frame 51, a loading unit 70, and a loading-unit drive motor 52 (see FIG. 2).

The loading-unit movement frame 51 is disposed in an upper area in the casing 1*b* (above the roll holding mechanism 4). The loading-unit movement frame 51 rotatably supports a loading-unit rotation shaft 70*a* described later. The loading-unit movement frame 51 is provided so as to be movable in the horizontal direction by a link mechanism. Specifically, the loading-unit movement frame 51 moves between a first position farthest from the film conveyance mechanism 6 and a second position closest to the film conveyance mechanism 6.

The loading unit 70 is attached to the loading-unit movement frame 51. The loading unit 70 includes a first grasping unit 71, a second grasping unit 72, and the loading-unit rotation shaft 70*a*.

Figure 7:
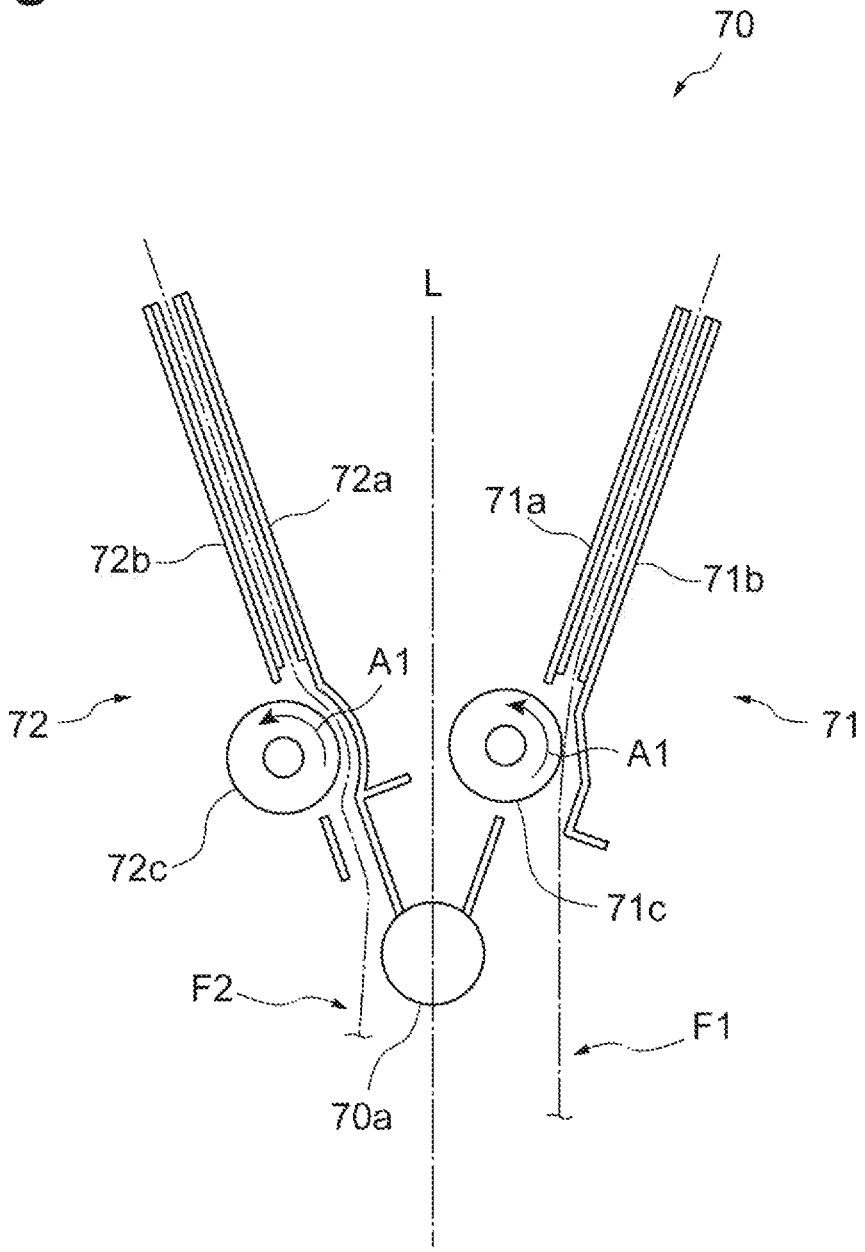
FIG. 7 is a diagram illustrating a loading unit.
Figure 8:
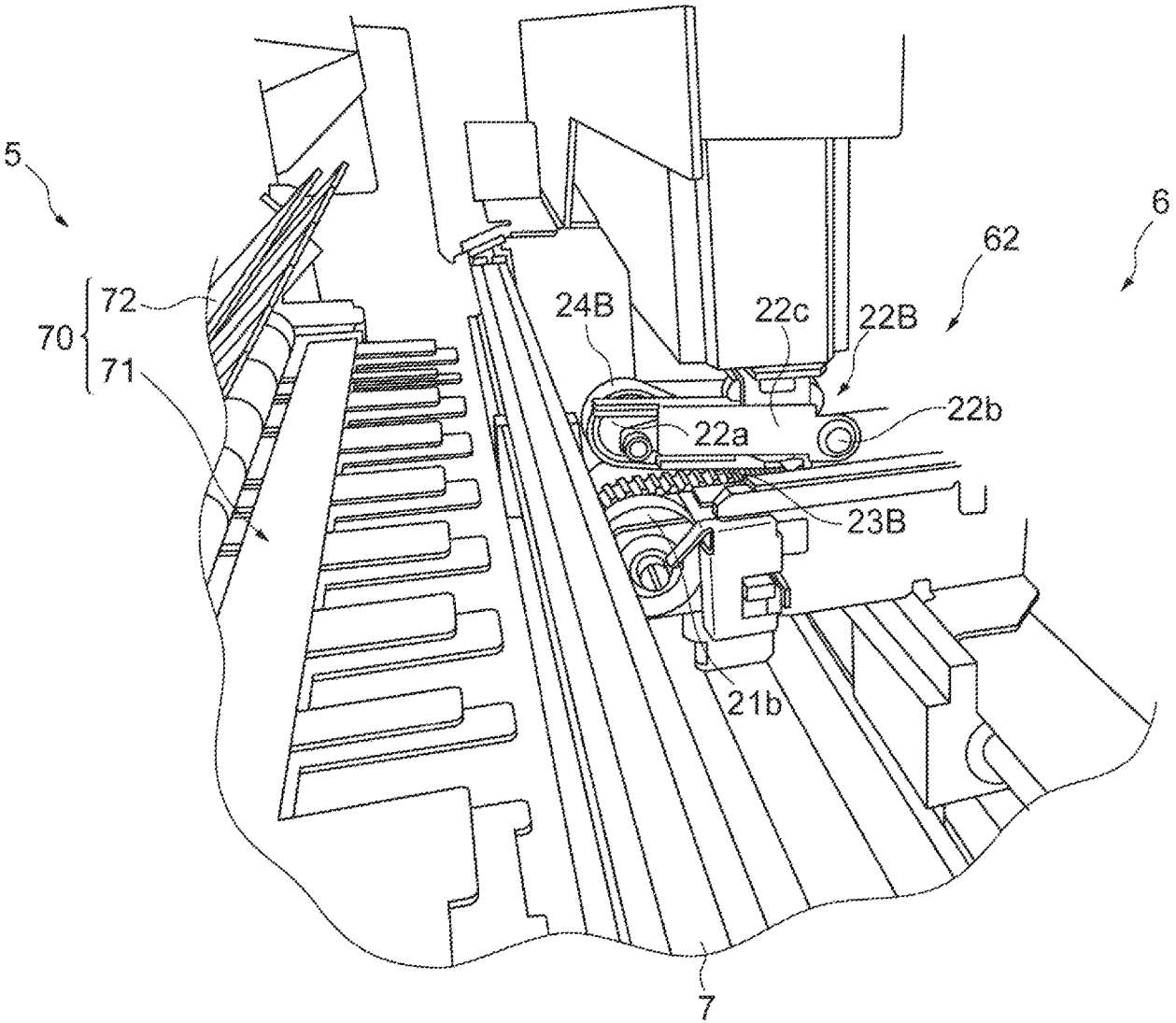
FIG. 8 is a perspective view illustrating a film delivering mechanism, a cutter mechanism, and a film conveyance mechanism.

As depicted in FIG. 7, the first grasping unit 71 and the second grasping unit 72 are attached to the loading-unit rotation shaft 70*a*. The first grasping unit 71 and the second grasping unit 72 are disposed at positions that are bilaterally symmetrical with respect to a reference line L. The reference line L is a straight line virtually extending from the center of the loading-unit rotation shaft 70*a* along the height direction of the loading-unit movement frame 51. The first grasping unit 71 and the second grasping unit 72 form a V shape.

Figure 4:
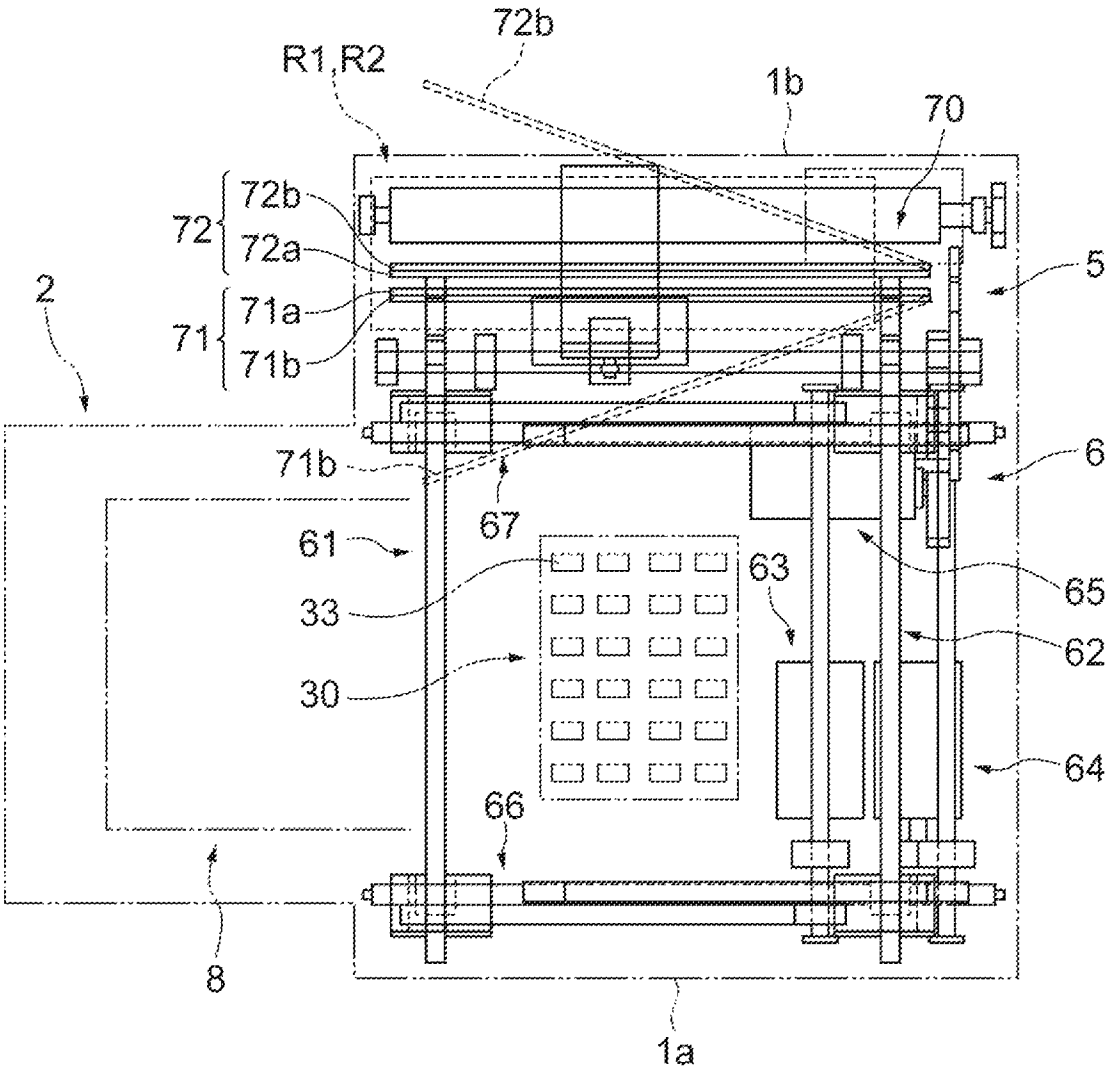
FIG. 4 is a schematic plan view of the packaging apparatus.

The first grasping unit 71 includes two plate members 71*a* and 71*b* and a one-way roller 71*c*. One end of the plate member 71*a* and one end of the plate member 71*b* are coupled together by a hinge (not depicted). As depicted in FIG. 4, the plate member 71*b* is provided so as to pivot about the hinge with respect to the plate member 71*a* and to be openable and closable with respect to the plate member 71*a*. The one-way roller 71*c* is a roller configured to allow rotation in only one direction (arrow A1 direction in FIG. 7). The one-way roller 71*c* is provided in plurality along the longitudinal direction (film-width direction) of the plate member 71*a*. The one-way rollers 71*c* hold a film F1 sandwiched between the plate member 71*a* and the plate member 71*b* so that the film F1 does not fall off downward.

As depicted in FIG. 7, the second grasping unit 72 includes two plate members 72*a* and 72*b* and a one-way roller 72*c*. One end of the plate member 72*a* and one end of the plate member 72*b* are coupled by a hinge (not depicted). As depicted in FIG. 4, the plate member 72*b* is provided so as to pivot about the hinge with respect to the plate member 72*a* and to be openable and closable with respect to the plate member 72*a*. The one-way roller 72*c* is a roller configured to allow rotation in only one direction (arrow A1 direction in FIG. 7). The one-way roller 72*c* is provided in plurality along the longitudinal direction (film-width direction) of the plate member 72*a*. The one-way rollers 72*c* hold a film F2 sandwiched between the plate member 72*a* and the plate member 72*b* so that the film F2 does not fall off downward.

The first grasping unit 71 and the second grasping unit 72 are used in a switched manner depending on the type of the film (the film F1 or the film F2). The first grasping unit 71 is a unit configured to grasp the film F1. The second grasping unit 72 is a unit configured to grasp the film F2. The first grasping unit 71 and the second grasping unit 72 each have a predetermined length in the depth direction of the casing 1*b* so that the film F1, F2 can be delivered.

The loading-unit rotation shaft 70*a* is rotatably supported by the loading-unit movement frame 51. The loading-unit rotation shaft 70*a* is driven by the loading-unit drive motor 52 (see FIG. 2). By changing the rotation angle of the loading-unit rotation shaft 70*a*, the loading unit 70 changes attitudes as depicted in FIG. 6A to FIG. 6C.

As depicted in FIG. 6A, when the loading unit 70 causes the first grasping unit 71 to grasp the film F1 or causes the second grasping unit 72 to grasp the film F2, the first grasping unit 71 and the second grasping unit 72 are positioned symmetrically with respect to the reference line L (loading position).

As depicted in FIG. 6B, when the loading unit 70 causes the first grasping unit 71 to transfer (deliver) the film F1 to the film conveyance mechanism 6, the first grasping unit 71 is tilted so as to be parallel to the horizontal plane (feeding position). Accordingly, the film F1 is delivered horizontally from the distal end of the first grasping unit 71 to the film conveyance mechanism 6.

As depicted in FIG. 6C, when the loading unit 70 causes the second grasping unit 72 to transfer the film F2 to the film conveyance mechanism 6, the second grasping unit 72 is tilted so as to be parallel to the horizontal plane (feeding position). Accordingly, the film F2 is delivered horizontally from the distal end of the second grasping unit 72 to the film conveyance mechanism 6.

As depicted in FIG. 2 and FIG. 3, the film conveyance mechanism 6 receives the film F from the film delivering mechanism 5 and conveys the film F to the packaging station 3. The film conveyance mechanism 6 also tensionally holds the film F received from the film delivering mechanism 5 in a central area of the packaging station 3. The film conveyance mechanism 6 includes the first feeder unit (first conveying unit) 61, the second feeder unit (second conveying unit) 62, a first feeder moving unit (first moving unit) 63, a second feeder moving unit (second moving unit) 64, and a feeder driving unit 65.

As depicted in FIG. 4, the first feeder unit 61 is disposed on the near side in the front-back direction of the packaging apparatus 1. The second feeder unit 62 is disposed on the far side with respect to the first feeder unit 61 in the front-back direction of the packaging apparatus 1. The first feeder unit 61 and the second feeder unit 62 are disposed along the longitudinal direction of the film F. The first feeder unit 61 and the second feeder unit 62 are driven by the feeder driving unit 65 to convey the film F.

In both end portions of the first feeder unit 61 and the second feeder unit 62 in the longitudinal direction, as depicted in FIG. 4, slide shafts 66 and 67 extending in the width direction of the film F are provided. The slide shafts 66 and 67 support the first feeder unit 61 and the second feeder unit 62. The first feeder unit 61 and the second feeder unit 62 are respectively driven by the first feeder moving unit 63 and the second feeder moving unit 64 to move along the slide shafts 66 and 67 in the film-width direction.

The first feeder unit 61 and the second feeder unit 62 have the same configuration. The following describes the configuration of the first feeder unit 61 as one example in detail with reference to FIG. 8 and FIG. 9A to FIG. 9C.

The first feeder unit 61 includes an introducing unit (first clamp unit) 22A, a lower belt 23A, an upper belt 24A, an upstream clamp 25A, a midstream clamp 26A, and a downstream clamp 27A. These respective components are supported by a supporting frame 21. The lower belt 23A and the upper belt 24A constitute a first feeder portion configured to convey the film F.

Figure 9A:
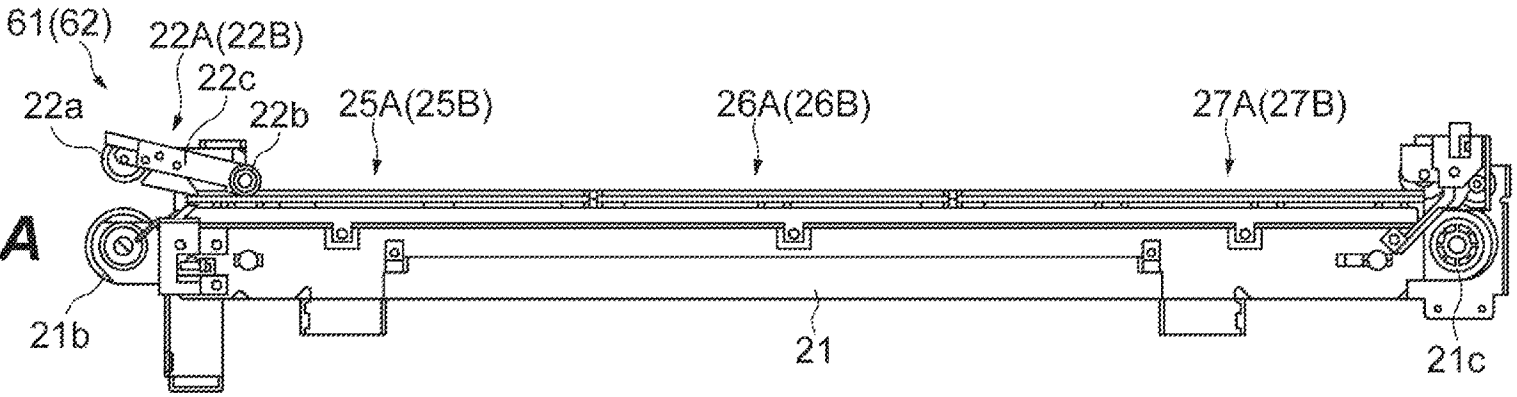
FIG. 9A is a diagram illustrating a first feeder unit (second feeder unit)
Figure 9B:
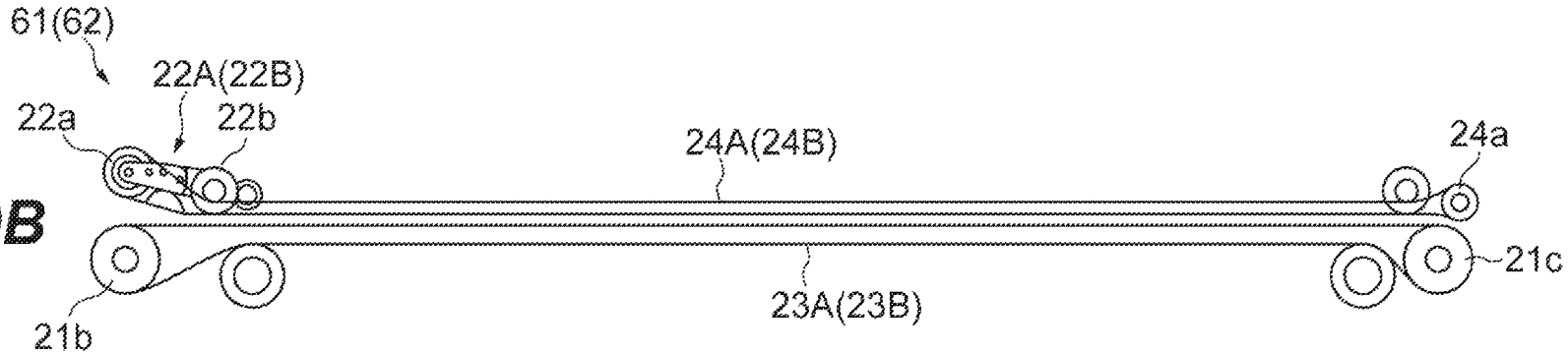
FIG. 9B is a diagram illustrating the first feeder unit (second feeder unit)
Figure 9C:
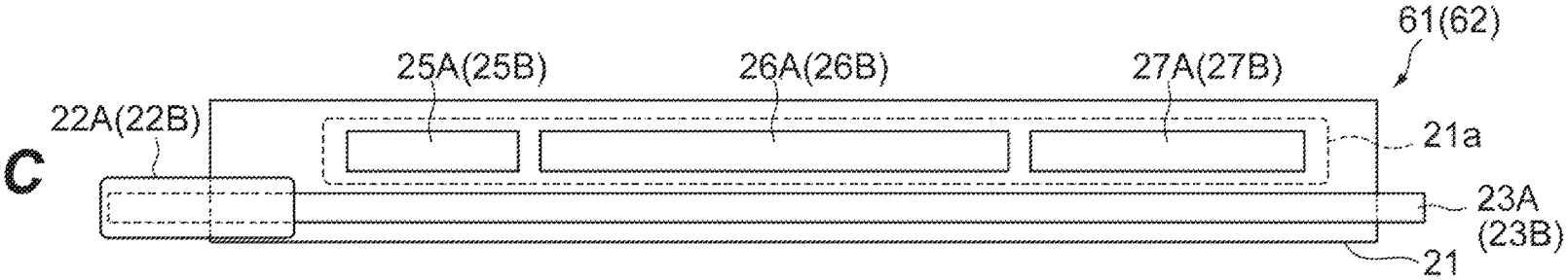
FIG. 9C is a diagram illustrating the first feeder unit (second feeder unit)

The introducing unit 22A clamps the film F delivered from the film delivering mechanism 5 to introduce the film F between the lower belt 23A and the upper belt 24A. The introducing unit 22A is disposed upstream of the first feeder unit 61, that is, near the loading unit 70 (see FIG. 8). As depicted in FIG. 9C, the introducing unit 22A is provided in a position overlapping the lower belt 23A.

The introducing unit 22A includes a body portion 22*c* provided swingably about an introducing-unit pivot shaft 22*b*. The introducing-unit pivot shaft 22*b* is provided to the downstream end of the body portion 22*c*. The introducing-unit pivot shaft 22*b* is supported by the frame 21. The body portion 22*c* swings upon actuation of a solenoid (not depicted). Specifically, upon actuation of the solenoid, the body portion 22*c* swings within a range between a lower position at which the upstream end of the body portion 22*c* is close to the lower belt 23A and an upper position at which the upstream end of the body portion 22*c* is apart from the lower belt 23A. The introducing unit 22A clamps the film F when the body portion 22*c* is in the lower position, and does not clamp the film F when the body portion 22*c* is in the upper position.

To the other end (end close to the film delivering mechanism 5) of the body portion 22*c*, an introducing pulley 22*a* is rotatably provided. Over the introducing pulley 22*a*, the upper belt 24A is looped.

The lower belt 23A comes into contact with the film F from below. The lower belt 23A is looped over a plurality of pulleys as depicted in FIG. 9B. These pulleys include a pulley 21*b* and a pulley 21*c*. The pulley 21*b* is disposed upstream in the conveying direction of the film F. The pulley 21*c* is disposed downstream in the conveying direction of the film F. The pulley 21*c* is rotated by a drive motor. The pulley 21*b* is driven by the rotation of the pulley 21*c*. Driven by the pulley 21*c* rotated by the drive motor, the lower belt 23A of the first feeder unit 61 moves.

The upper belt 24A is looped over a plurality of pulleys as depicted in FIG. 9B. These pulleys include the introducing pulley 22*a* of the introducing unit 22A and a pulley 24*a*. The pulley 24*a* is disposed downstream in the conveying direction of the film F. The pulley 24*a* is rotated by the drive motor that rotates the pulley 21*c*. Thus, the upper belt 24A is driven together with the lower belt 23A. With the above-described configuration, the first feeder unit 61 draws in the film between the upper belt 24A and the lower belt 23A, and conveys the film F in the longitudinal direction (first direction) of the film F in which the film F is paid out.

As depicted in FIG. 9C, the upstream clamp 25A is disposed upstream in the conveying direction of the film. The downstream clamp 27A is disposed downstream in the conveying direction of the film. The midstream clamp 26A is disposed between the upstream clamp 25A and the downstream clamp 27A. The respective clamps 25A to 27A are disposed in positions displaced from the belts 23 and 24. Specifically, the respective clamps 25A to 27A are disposed on the inner side of the belts 23A and 24A in the width direction of the film F. Below the respective clamps 25A to 27A, a band plate 21*a* is disposed.

Each of the clamps 25A to 27A operates in accordance with ON/OFF switching of a solenoid (not depicted). Specifically, each of the clamps 25A to 27A clamps the film F and releases the film F in accordance with ON/OFF switching of the corresponding solenoid. Each of the clamps 25A to 27A comes into contact with the upper surface of the film F1, F2 to apply a downward force thereto when the corresponding solenoid is ON. Accordingly, the film F is clamped between the band plate 21*a* and each of the clamps 25A to 27A. Each of the clamps 25A to 27A releases the clamped film F when the corresponding solenoid is OFF. Each solenoid can be switched ON at a predetermined timing.

The second feeder unit 62 has the same configuration as that of the first feeder unit 61. Specifically, the second feeder unit 62 includes an introducing unit (second clamp unit) 22B, a lower belt 23B, an upper belt 24B, an upstream clamp 25B, a midstream clamp 26B, and a downstream clamp 27B. These respective components are supported by the supporting frame 21. The lower belt 23B and the upper belt 24B constitute a second feeder portion configured to convey the film F.

The first feeder moving unit 63 is attached below the first feeder unit 61. As depicted in FIG. 3, the first feeder moving unit 63 includes a drive motor 63*a* and a belt 63*b*. The second feeder moving unit 64 is attached below the second feeder unit 62. As depicted in FIG. 3, the second feeder moving unit 64 includes a drive motor 64*a* and a belt 64*b*.

The first feeder moving unit 63 causes the drive motor 63*a* to drive the belt 63*b*, thereby moving the first feeder unit 61 along the slide shafts 66 and 67 in the width direction (second direction) of the film F. The second feeder moving unit 64 causes the drive motor 64*a* to drive the belt 64*b*, thereby moving the second feeder unit 62 along the slide shafts 66 and 67 in the width direction of the film F.

As depicted in FIG. 2, after the film delivering mechanism 5 transfers the film F to the film conveyance mechanism 6, the cutter mechanism 7 cuts the film F stretched between the film delivering mechanism 5 and the film conveyance mechanism 6. After the film conveyance mechanism 6 conveys the film F of a predetermined length, the cutter mechanism 7 cuts the film F stretched between the film delivering mechanism 5 and the film conveyance mechanism 6. The cutter mechanism 7 is disposed between the film delivering mechanism 5 and the film conveyance mechanism 6, and includes a cutting blade 7*a* that is longer than the film width of the film F. The cutting blade 7*a* is moved vertically by an actuator.

The seal mechanism 8 heat-seals the film F that is folded by the folding mechanism 37. The seal mechanism 8 includes a conveying roller and heating roller, and heat-seals an object W pushed out by the discharging pusher 79*a* while conveying the object W by the conveying roller and the heating roller. The seal mechanism 8 discharges the object W thus packaged toward a discharge table 82.

Figure 5:
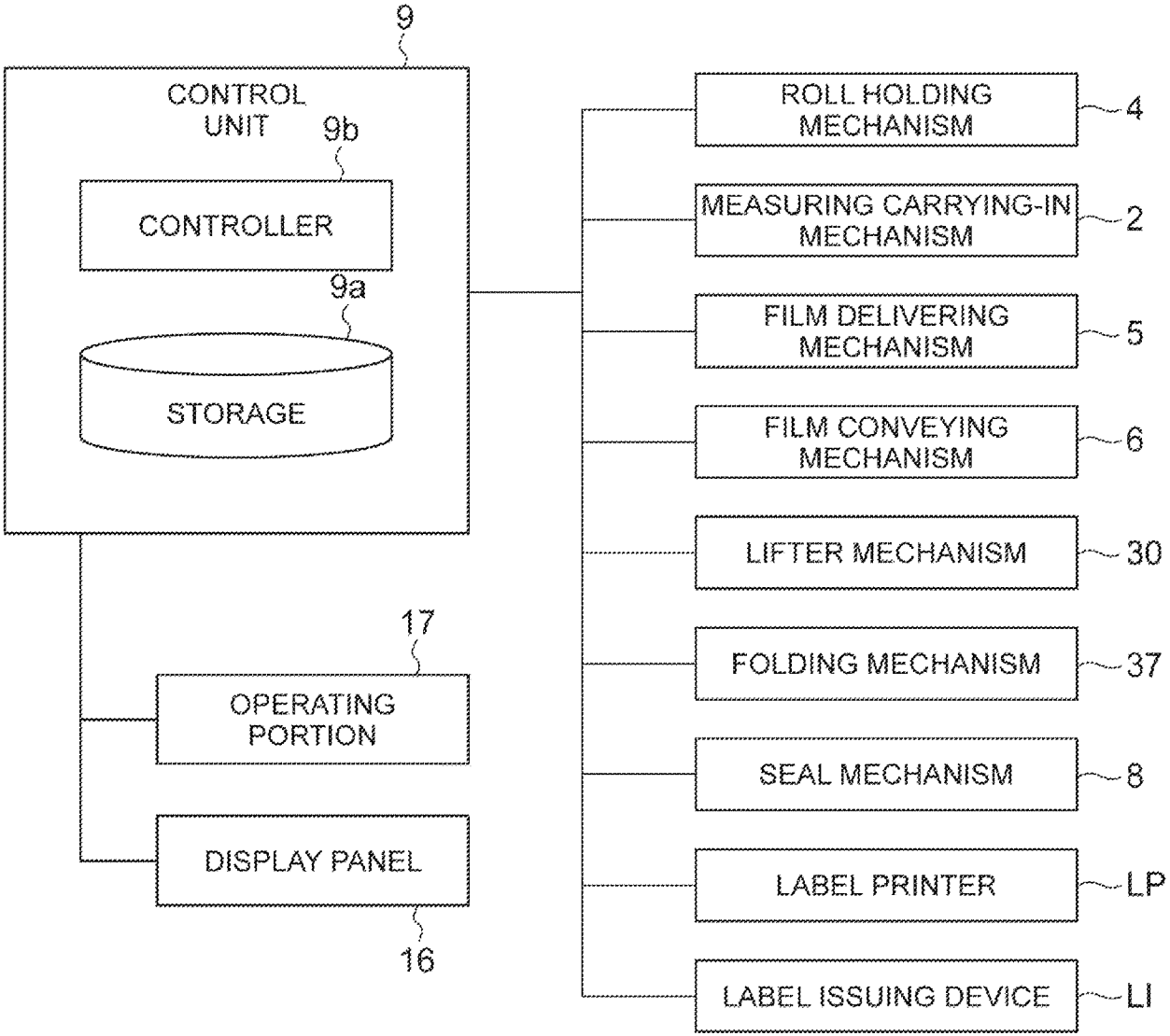
FIG. 5 is a block diagram illustrating a configuration of the packaging apparatus in FIG. 1.

As depicted in FIG. 1 and FIG. 5, the label printer LP prints information about goods on a label. Examples of the information about goods include a product name and price. The label issuing device LI pastes the label printed by the label printer LP on the discharged packaged product.

The control unit 9 is a computer disposed in an upper portion of the body 1*a*. The control unit 9 controls operation of each mechanism described above. The control unit 9 includes an input/output interface I/O configured to perform signal input and output from and to the outside, a read only memory (ROM) in which a program and information, for example, for performing processes are stored, a random access memory (RAM) configured to temporarily store therein data, a recording medium such as a hard disk drive (HDD), a central processing unit (CPU), and a communication circuit, for example. The control unit 9 implements each function, based on signals output by the CPU, by storing input data in the RAM, loading the program stored in the ROM into the RAM, and executing the program loaded in the RAM.

To the control unit 9, a display panel 16 and an operating portion 17 are connected. The display panel 16 is a touch-panel display, for example, and operation buttons are displayed on the display. With the operating portion 17, a user performs various operations and inputs.

The control unit 9 includes a storage 9*a* and a controller 9*b*. In the storage 9*a*, various types of data that are predetermined, are input from the display panel 16 or the operating portion 17, for example, or are transferred from an external device are stored. These various types of data include data on properties (thickness, material, film width, etc.) of a plurality of types of films F, data on unit price data and properties of a plurality of types of products data on properties (size, shape, material, tare weight, etc.) of a plurality of types of trays T.

The controller 9*b* controls operation of each mechanism. When the film F is loaded onto the first feeder unit 61 and the second feeder unit 62, the controller 9*b* causes the introducing unit 22A to clamp the film F delivered by the film delivering mechanism 5 and causes the lower belt 23A and the upper belt 24A to convey the film F. Simultaneously, while causing the introducing unit 22B to open or the introducing unit 22B to intermittently clamp the film F delivered by the film delivering mechanism 5, the controller 9*b* causes the lower belt 23B and the upper belt 24B to convey the film F and also causes the second feeder unit 62 to move in the direction separating from the first feeder unit 61 and, when the second feeder unit 62 reaches a predetermined position in the second direction, causes the introducing unit 22B to clamp the film F. In other words, the controller 9 is a circuit configured to, when the film F is loaded onto the first feeder unit 61 and the second feeder unit 62, cause the introducing unit 22A to clamp the film F delivered by the film delivering mechanism 5 and cause the lower belt 23A and the upper belt 24A to convey the film F, and simultaneously, while causing the introducing unit 22B to open or the introducing unit 22B to intermittently clamp the film F delivered by the film delivering mechanism 5, cause the lower belt 23B and the upper belt 24B to convey the film F and also cause the second feeder unit 62 to move in the direction separating from the first feeder unit 61 and, when the second feeder unit 62 reaches the predetermined position in the second direction, cause the introducing unit 22B to clamp the film F. Specific operation of the controller 9*b* will be described later.

The control unit 9 thus configured refers to various types of data in the storage 9*a* and, based on the weight and/or the tray size of an object W measured by the measuring carrying-in mechanism 2, calculates the price of the object W, for example. The control unit 9 controls operation of the label printer LP and the label issuing device LI, and prints the weight or the price of the object W on a label.

The following schematically describes packaging operation in the packaging apparatus 1.

In the packaging apparatus 1, when a user places an object W on the measuring vessel 12 of the measuring carrying-in mechanism 2, the weight of the object W is measured by the measuring scale 2*a*. The object W is pushed out onto the support members 33 of the lifter mechanism 30 by the conveying bar 13. Meanwhile, the film F is transferred to the film conveyance mechanism 6 by the film delivering mechanism 5, and the film F is cut by the cutter mechanism 7 into a sheet of rectangular film F. The film F is conveyed to above the lifter mechanism 30 by the feeder units 61 and 62, and both side portions thereof in the width direction are tensionally held.

Against the film F thus tensionally held, the object W is pushed up by the lifter mechanism 30, and the film F is stretched so as to cover the object W. The periphery of the film F is folded over the lower side of the tray T by the folding mechanism 37. The object W is pushed out toward the seal mechanism 8 by the discharging pusher 79*a*. Subsequently, the film F is heat-sealed by the seal mechanism 8, and is then discharged onto the discharge table 82.

When a process including label pasting is performed, the price and the weight, for example, of the product G calculated based on the measured value are printed on a label by the label printer LP, and this label is pasted on the film F by the label issuing device LI.

The following describes loading operation in the packaging apparatus 1 with reference to FIG. 10A to FIG. 12B. In the following description, operation of newly setting a film roll R1 and loading a film F1 will be described as one example.

Figure 10A:
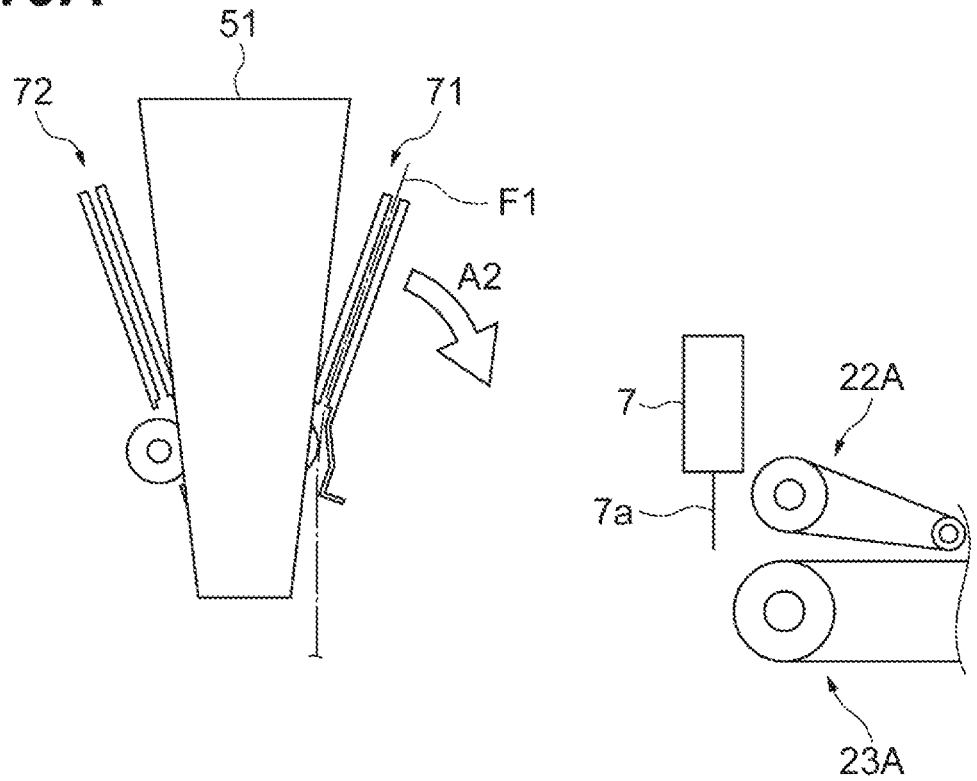
FIG. 10A is a diagram illustrating a loading operation.

In the packaging apparatus 1, when a film set button (not depicted) is depressed by an operator, the controller 9*b* causes the loading-unit drive motor 52 of the film delivering mechanism 5 to drive, thereby moving the loading unit 70 to the loading position as depicted in FIG. 10A. The operator pulls out an end of the film F1 from the film roll R1, and sets the film F1 into the first grasping unit 71 of the loading unit 70. Specifically, the operator opens the plate member 71*b* of the first grasping unit 71 with respect to the plate member 71*a* to set the film F1.

Figure 10B:
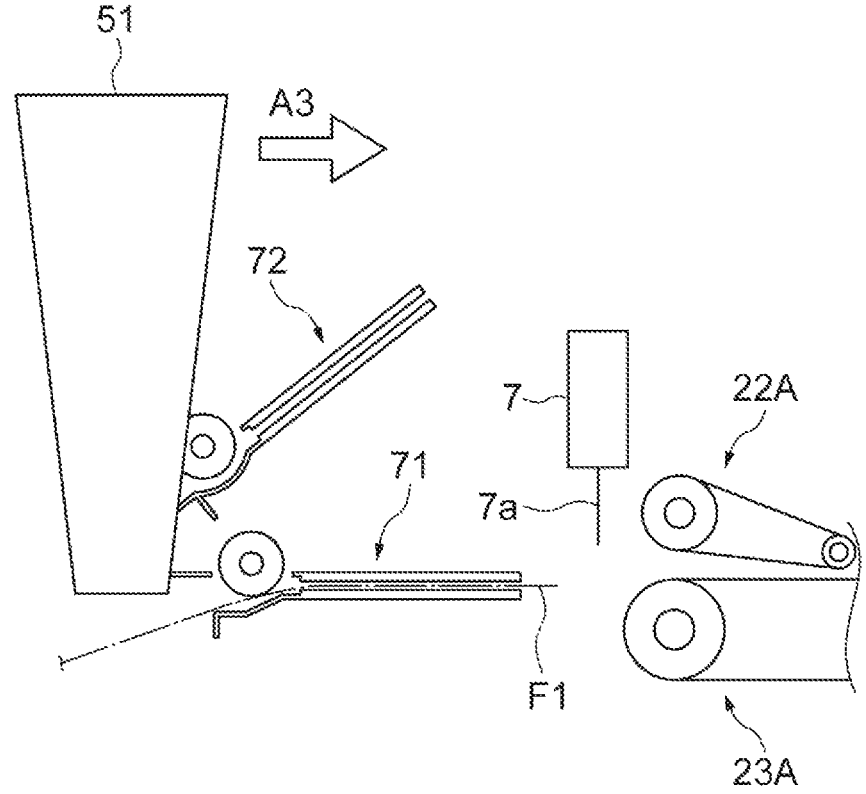
FIG. 10B is a diagram illustrating a loading operation.

Subsequently, when a film loading button (not depicted) is depressed by the operator, the controller 9*b* causes the loading-unit drive motor 52 to drive, thereby tilting the loading unit 70 in the arrow A2 direction as depicted in FIG. 10A and causing the loading unit 70 to move to the feeding position. Accordingly, as depicted in FIG. 10B, the first grasping unit 71 becomes parallel to the horizontal plane. The controller 9*b* also causes the loading-unit movement frame 51 to move in the arrow A3 direction as depicted in FIG. 10B, so that the loading-unit movement frame 51 is positioned in the second position closer to the film conveyance mechanism 6.

Figure 11A:
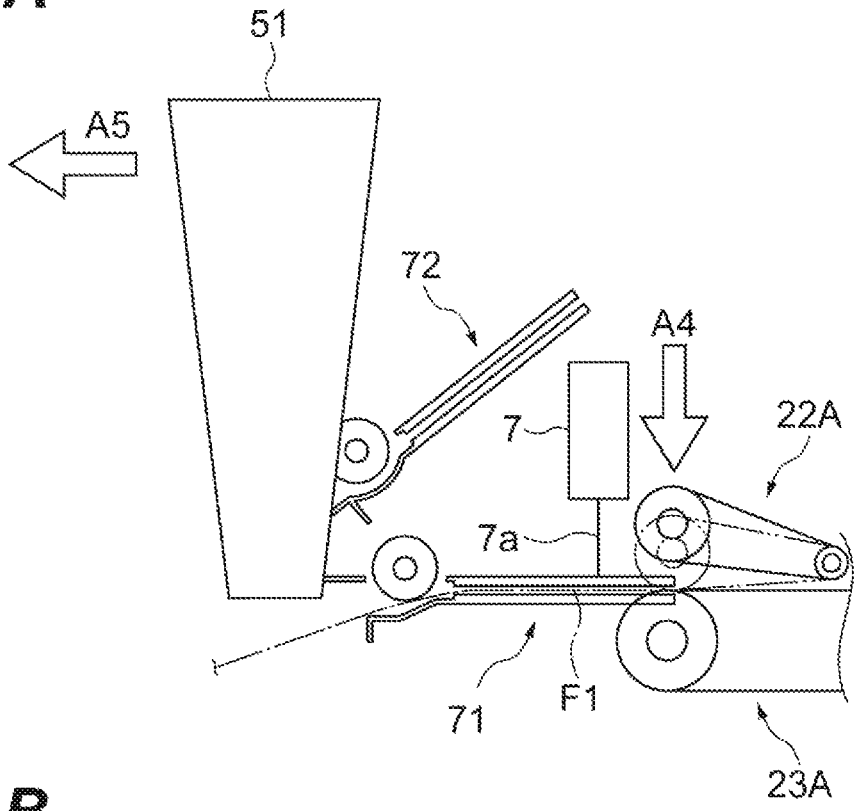
FIG. 11A is a diagram illustrating a loading operation.

Subsequently, as depicted in FIG. 11A, the controller 9*b* causes the introducing unit 22A of the first feeder unit 61 to swing in the arrow 4A direction, so that the introducing unit 22A is positioned in the lower position. Accordingly, between the introducing unit 22A and the lower belt 23A, the film F1 grasped by the first grasping unit 71 is clamped.

Subsequently, the controller 9*b* causes the drive motor configured to drive the pulley 21*c* of the lower belt 23A to operate. Accordingly, the first feeder unit 61 introduces the film F1, and also conveys the film F1 downstream while drawing in the film F1 between the lower belt 23A and the upper belt 24A. The controller 9*b* also causes the loading-unit movement frame 51 to move in the arrow A5 direction as depicted in FIG. 11A, so that the loading-unit movement frame 51 is positioned in the first position farther from the film conveyance mechanism 6.

The controller 9*b* causes the first feeder unit 61 to convey the film F1 of the predetermined length, and then switches ON the solenoid of the midstream clamp 26A, for example. Accordingly, the film F1 is clamped between the midstream clamp 26A and the band plate 21*a*. The controller 9*b* causes the first feeder unit 61 to further convey the film F1 with the film F1 being clamped by the midstream clamp 26A. Accordingly, the film F1 stays between the lower belt 23A and the upper belt 24A.

While the introducing unit 22B of the second feeder unit 62 is positioned in the upper position, the controller 9*b* causes the drive motor configured to drive the pulley 21*c* of the lower belt 23B to operate, thereby conveying the film F1 downstream while drawing in the film F1 between the lower belt 23B and the upper belt 24B without clamping the film F1. Herein, the timing at which the second feeder unit 62 starts conveying the film F1 may be the same as the timing at which the first feeder unit 61 starts conveying the film F1, or may be after the first feeder unit 61 has started conveying the film F1.

Figure 12A:
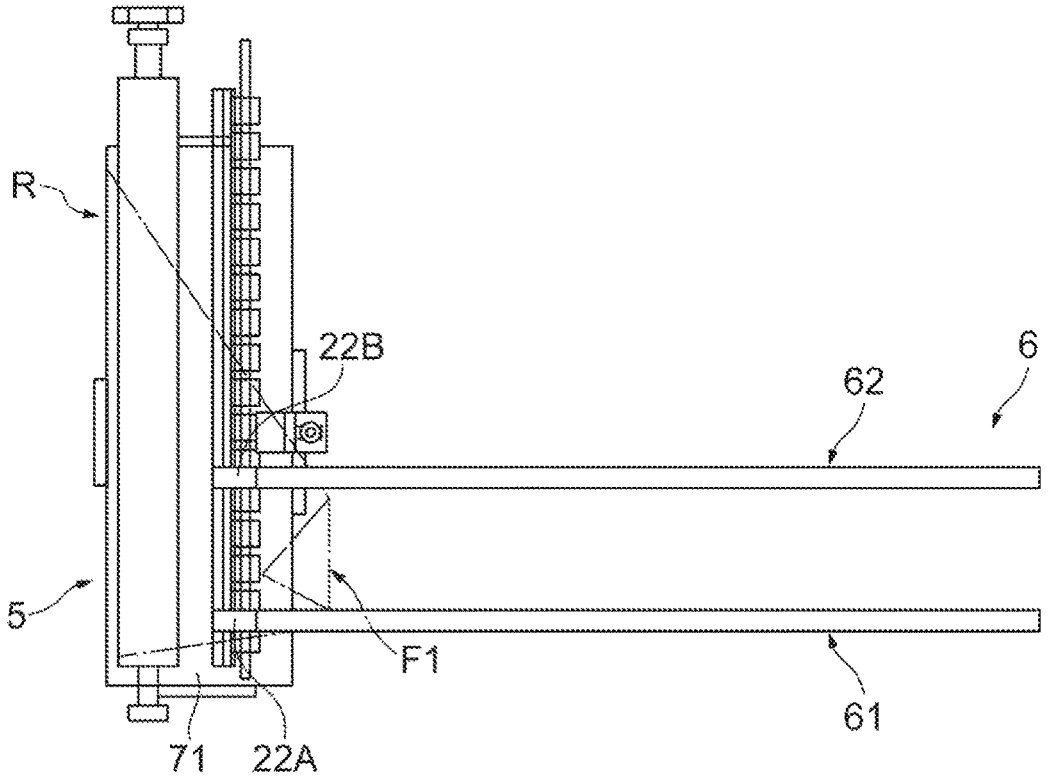
FIG. 12A is a diagram illustrating a loading operation.
Figure 12B:
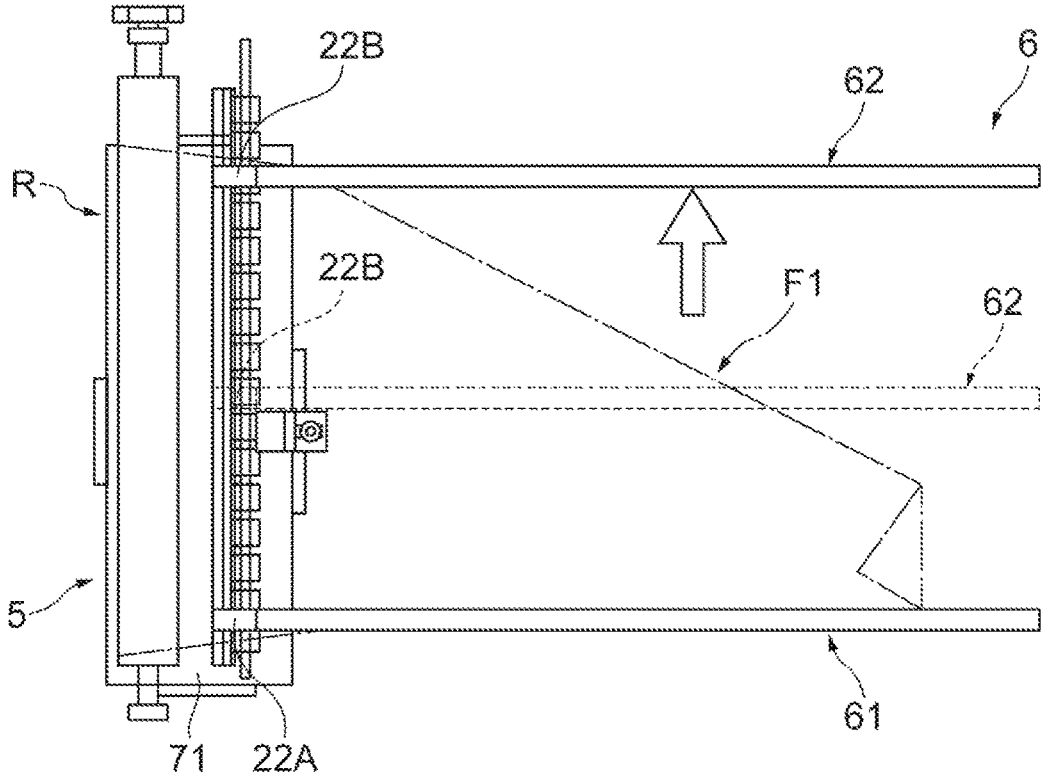
FIG. 12B is a diagram illustrating a loading operation.

The controller 9*b* causes the drive motor 64*a* of the second feeder moving unit 64 to drive, thereby moving the second feeder unit 62 toward the far side (direction separating from the first feeder unit 61) from the position depicted in FIG. 12A to the position depicted in FIG. 12B. At this time, when the second feeder unit 62 reaches the position at a length equal to one half of the film width as indicated by the dashed line in FIG. 12B, the controller 9*b* causes the introducing unit 22B to be positioned in the lower position. Accordingly, the second feeder unit 62 conveys the film F1 with the lower belt 23B and the upper belt 24B while clamping the film F1 with the introducing unit 22B from the position at a length equal to one half of the film width.

Figure 11B:
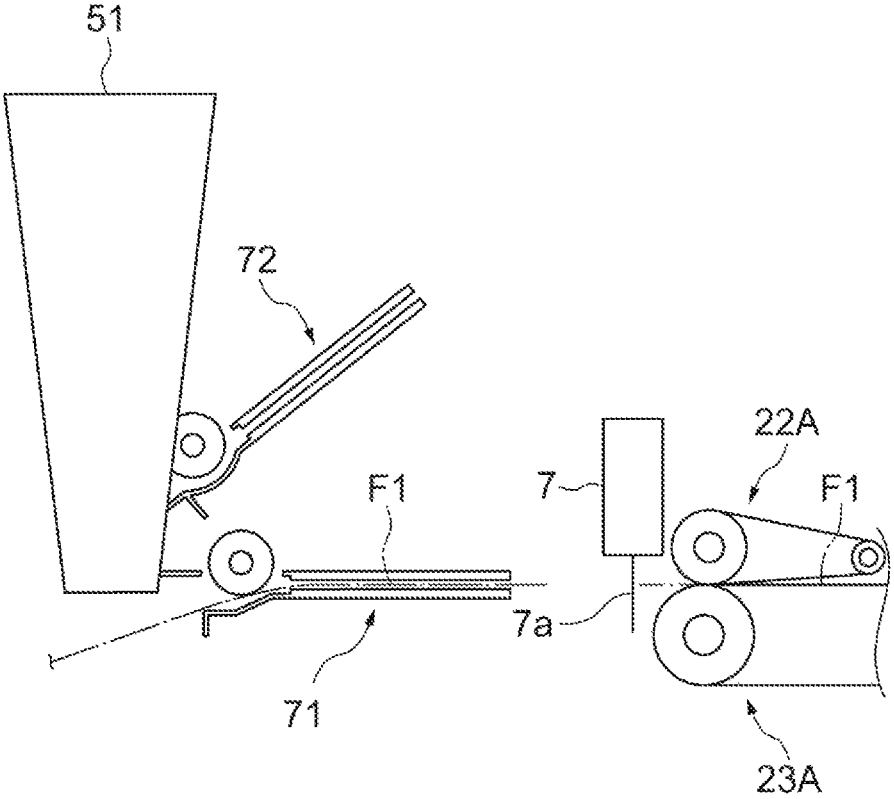
FIG. 11B is a diagram illustrating a loading operation.

After the second feeder unit 62 is moved to the end (position depicted in FIG. 12B) in the film-width direction, when the film F1 of the predetermined length is introduced into the second feeder unit 62, the controller 9*b* causes the cutter mechanism 7 to operate as depicted in FIG. 11B. Consequently, the film F1 spread between the film delivering mechanism 5 and the film conveyance mechanism 6 is cut. After the film F1 is cut, the controller 9*b* causes the introducing unit 22A of the first feeder unit 61 and the introducing unit 22B of the second feeder unit 62 to release the clamped film F2. This ends the loading process of the film F1.

As described in the foregoing, in the packaging apparatus 1 according to the present embodiment, when the film F is loaded onto the first feeder unit 61 and the second feeder unit 62, the controller 9*b* causes the introducing unit 22A to clamp the film F1 delivered by the film delivering mechanism 5 and causes the lower belt 23A and the upper belt 24A to convey the film F, simultaneously causes the lower belt 23B and the upper belt 24B to convey the film F with the introducing unit 22B being open (without clamping the film F) and also causes the second feeder unit 62 to move in the direction separating from the first feeder unit 61 and, when the second feeder unit 62 reaches the predetermined position in the film-width direction, causes the introducing unit 22B to clamp the film F.

Accordingly, until the second feeder unit 62 reaches the predetermined position in the film-width direction, the film F is not clamped by the introducing unit 22B. This can prevent the film F from adhering to the lower belt 23B and the upper belt 24B at least until the predetermined position is reached, which makes it possible to prevent formation of a bundle of films F inside the lower belt 23B and the upper belt 24B. Thus, the packaging apparatus 1 can prevent occurrence of a problem due to film jam.

In the present embodiment, the packaging apparatus 1 further includes the cutter mechanism 7 configured to cut the film F between the film delivering mechanism 5 and the first and the second feeder units 61 and 62. The controller 9*b* causes the cutter mechanism 7 to cut the film F and then causes the introducing unit 22A and the introducing unit 22B to release the clamped film F. This enables an operator to easily remove the cut film F.

In the present embodiment, when the second feeder unit 62 reaches the position at a length equal to or greater than one half of the film width in the film-width direction, the controller 9*b* causes the introducing unit 22B to clamp the film F. This enables the film F to be further prevented from adhering to the lower belt 23B and the upper belt 24B.

The present disclosure is not limited to the above-described embodiment. Although a measuring packaging price-tagging apparatus configured to perform measurement, packaging, and price tagging has been described as the packaging apparatus 1 in the above-described embodiment, the packaging apparatus 1 may be configured not to perform measurement and/or price tagging.

In the above-described embodiment, a mode has been described as one example in which the introducing unit 22B is caused to clamp the film F when the second feeder unit 62 reaches the predetermined position (e.g., the position at a length equal to or greater than one half of the film width) in the film-width direction. However, the controller 9*b* may perform control so as to cause the introducing unit 22B to intermittently clamp the film F until the second feeder unit 62 reaches the predetermined position in the film-width direction. The expression "to intermittently clamp" means to clamp the film F and release the clamped film F at a certain or uncertain timing. The period of time for which the film F is clamped may be set as appropriate. The predetermined position at which clamping of the film F is continuously started in the introducing unit 22B may be set based on the design as appropriate.

At least part of the above-described embodiment may be optionally combined.

What is claimed is:

1. A packaging apparatus configured to package an object to be packaged by covering the object to be packaged with an adhesive film that is stretched while a peripheral portion of the film is being held, the packaging apparatus comprising:

a delivering unit configured to deliver the film from a film roll onto which the film is wound;

a first conveying unit including a first clamp unit and a first feeder portion, the first clamp unit being configured to clamp the film delivered from the delivering unit, the first feeder portion being configured to convey the film clamped by the first clamp unit in a first direction that is a direction in which the film is paid out;

a second conveying unit including a second clamp unit and a second feeder portion, the second clamp unit being configured to clamp the film delivered from the delivering unit, the second feeder portion being configured to convey the film clamped by the second clamp unit in the first direction;

a first moving unit configured to move the first conveying unit in a second direction that is a width direction of the film;

a second moving unit configured to move the second conveying unit in the second direction; and a controller configured to control operation of the first conveying unit, the second conveying unit, the first moving unit, and the second moving unit, wherein when the film is loaded onto the first conveying unit and the second conveying unit, the controller causes the first clamp unit to clamp the film delivered by the delivering unit and causes the first feeder portion to convey the film, and simultaneously, while causing the second clamp unit to remain open to thereby prevent adherence of the film to the second clamp unit, causes the second feeder portion to convey the film and also causes the second conveying unit to move in a direction separating from the first conveying unit and, when the second conveying unit reaches a predetermined position in the second direction, causes the second clamp unit to clamp the film, and the predetermined position is a position spaced apart from the first conveying unit by a distance, in the second direction, equal to or greater than one half of a width of the film and equal to or less than the width of the film.

2. A packaging apparatus configured to package an object to be packaged by covering the object to be packaged with an adhesive film that is stretched while a peripheral portion of the film is being held, the packaging apparatus comprising:

a delivering unit configured to deliver the film from a film roll onto which the film is wound;

a first conveying unit including a first clamp unit and a first feeder portion, the first clamp unit being configured to clamp the film delivered from the delivering unit, the first feeder portion being configured to convey the film clamped by the first clamp unit in a first direction that is a direction in which the film is paid out;

a second conveying unit including a second clamp unit and a second feeder portion, the second clamp unit being configured to clamp the film delivered from the delivering unit, the second feeder portion being configured to convey the film clamped by the second clamp unit in the first direction;

a first moving unit configured to move the first conveying unit in a second direction that is a width direction of the film;

a second moving unit configured to move the second conveying unit in the second direction;

a controller configured to control operation of the first conveying unit, the second conveying unit, the first moving unit, and the second moving unit; and a cutting unit configured to cut the film between the delivering unit and the first and the second conveying units, wherein when the film is loaded onto the first conveying unit and the second conveying unit, the controller causes the first clamp unit to clamp the film delivered by the delivering unit and causes the first feeder portion to convey the film, and simultaneously, while causing the second clamp unit to remain open to thereby prevent adherence of the film to the second clamp unit, causes the second feeder portion to convey the film and also causes the second conveying unit to move in a direction separating from the first conveying unit and, when the second conveying unit reaches a predetermined position in the second direction, causes the second clamp unit to clamp the film, the controller causes the cutting unit to cut the film, and then causes the first clamp unit and the second clamp unit to release the film, and the predetermined position is a position spaced apart from the first conveying unit by a distance, in the second direction, equal to or greater than one half of a width of the film and equal to or less than the width of the film.

* * * * *